United States Patent [19]

Habert

[11] 4,103,732

[45] Aug. 1, 1978

[54] DEVICE FOR THE DELIVERY AND UNIFORM DISTRIBUTION OF LUBRICANTS

[75] Inventor: Dietrich Habert, Eschweiler, Fed. Rep. of Germany

[73] Assignees: ARBED, Aciéries Réunies de Burbach-Eich-Dudelange S.A., Luxembourg, Luxembourg; Eschweiler Bergwerks-Verein AG, Herzogenrath-Kohlscheid, Fed. Rep. of Germany

[21] Appl. No.: 773,387

[22] Filed: Mar. 2, 1977

[30] Foreign Application Priority Data

Mar. 5, 1976 [DE] Fed. Rep. of Germany ..... 2609075

[51] Int. Cl.[2] ..... B22D 11/00

[52] U.S. Cl. ..... 164/147; 164/73; 164/418

[58] Field of Search ..... 164/73, 147, 268, 273 R

[56] References Cited

FOREIGN PATENT DOCUMENTS 742,771 12/1943 Fed. Rep. of Germany ..... 164/273 R

*Primary Examiner*—Francis S. Husar
*Assistant Examiner*—K. Y. Lin
*Attorney, Agent, or Firm*—W. G. Fasse; W. W. Roberts

[57] ABSTRACT

The inner surface of a continuous-casting mold is efficiently lubricated by a lubricating ring rotatably held in a respective recess around the upper edge of the mold. The lubricating ring has a ring chamber for receiving the lubricant and radially inwardly directed distribution channels connecting the ring chamber to the inner wall of the mold. The ring is rotated either by a rotating electromagnetic field or by the lubricant supply itself. In the latter embodiment there are wings in the ring chamber and the lubricant is fed into the ring chamber tangentially thereto.

4 Claims, 5 Drawing Figures

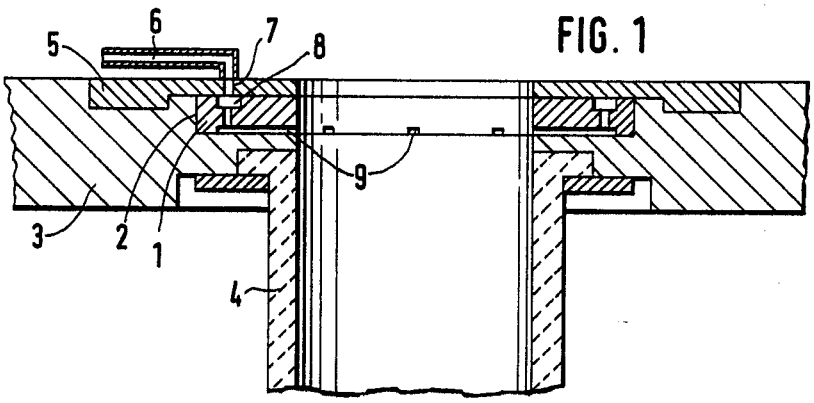
FIG. 1
FIG. 2
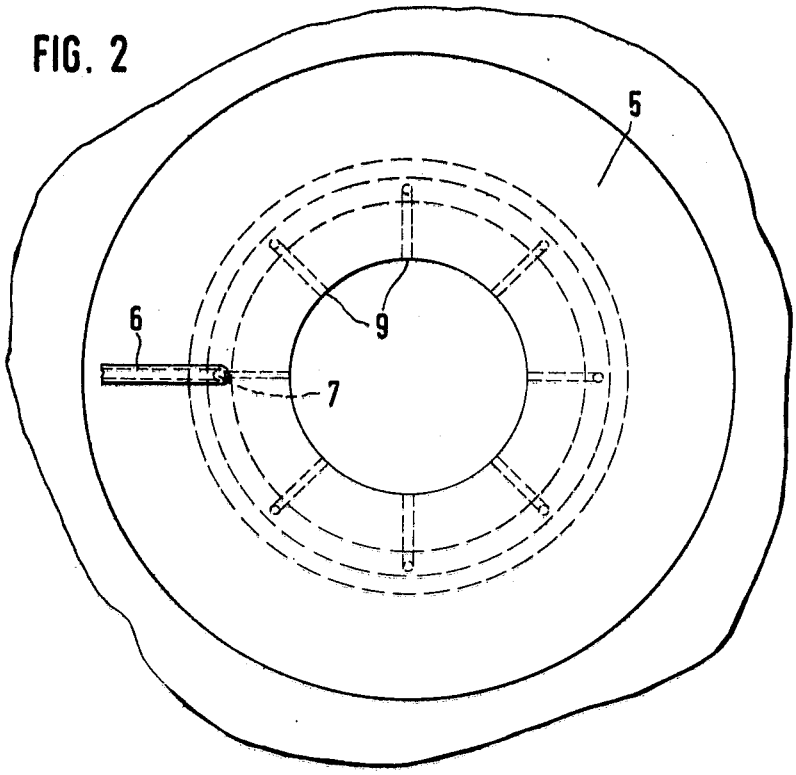

DEVICE FOR THE DELIVERY AND UNIFORM DISTRIBUTION OF LUBRICANTS

BACKGROUND OF THE INVENTION

The invention relates to a device for the delivery and uniform distribution of lubricants to the inside wall of a continuous-casting mold by means of a ring chamber.

In continuous-casting, a lubricant, for instance rape-oil, is applied as deep as possible to the inside wall of the mold, in order to improve the quality surface of the casting. The surface quality of the continuous-casting depends greatly on the dosing and the uniform distribution of the lubricant over the surface of the inner wall of the mold. Whereas, excessive dosing leads to pores in the surface of the casting and too small lubricant quantities lead to a scaly casting surface, a non-uniform distribution of the lubricant results in a casting surface which is porous in places and scaly in other places.

In the case of vertically disposed continuous-casting molds, one has been content heretofore to let the lubricant flow-in at the upper end of the mold at several points distributed about the circumference. The arrangement of a ring chamber around the mold has also been proposed heretofore for introducing lubricants to the inner wall of a rotatable, horizontal, continuous-casting mold for aluminum or aluminum alloys. Such ring chamber is closed off toward the mold cavity by a porous, fibrous confining wall, whereby the confining wall is additionally covered by the jacket of a feeding nozzle as disclosed in German Patent No. 1,939,512. This known device cannot be used for rotatable, vertical, continuous-casting molds, since the unprotected, porous fibrous confining wall of the ring chamber would be destroyed in a short time so that either lubricant can no longer issue through the clogged pores or the destroyed confining wall can no longer perform the distribution function at all, so that the lubricant flows from the ring chamber to the inner wall of the mold only at isolated places in excessive doses, while other places of the inner wall remain without lubricant.

OBJECT OF THE INVENTION

It is an object of the invention to provide a device for the delivery and uniform distribution of lubricants to the inside wall of a continuous-casting mold, which is distinguished by a simple structure and long-term reliability in operation.

SUMMARY OF THE INVENTION

To solve the stated problem, the invention starts out from the device described at the outset above and proposes that the ring chamber, which is arranged on an upper flange of the mold, is formed by a circular slot in a distributor ring that can be set in rotation, and/or in a stationary flange which covers up the distributor ring and which has a bore hole in the vicinity of the ring chamber for connecting a lubricant feed line from which radial slots and/or radial bores arranged in the distributor ring lead to the cavity of the mold in star-fashion.

According to one embodiment of the invention, the distributor ring is set in rotation by a nonstationary electromagnetic field and, for this purpose the distributor ring comprises magnetic and nonmagnetic sectors arranged in alternating fashion.

According to a further embodiment of the invention, the rotating electromagnetic field may be generated by an inductor which is arranged at the height of the pouring level of the mold. By utilizing a rotating electromagnetic field which is already provided for improving the surface quality and the internal structure of continuously-cast material at the height of the pouring level of the mold, separate driving devices for the distributor ring are not necessary.

The rotary motion of the distributor ring is not only not impeded by the inflow of lubricant but is even aided if, in a further embodiment of the invention, the hole for connecting the lubricant feed line is run tangentially to the ring chamber through the flange covering the distributor ring in the direction of rotation of the distributor ring.

According to a further embodiment of the invention, the distributor ring may have, for aiding the driving force derived from the rotating electromagnetic field, tab- or blade-shaped, radially extending or bent driving elements which are acted upon by the tangentially fed-in lubricant, so that the kinetic energy of the fed-in lubricant stream is utilized for the rotary motion of the distributor ring. It is within the scope of the invention to construct, in the absence of a rotating electromagnetic field, the driving elements similar to turbine blades in such a manner that they bring about sufficient rotation of the distributor ring without any further driving force except the action of the lubricant from the feed line alone.

BRIEF FIGURE DESCRIPTION

An example embodiment of the device according to the invention is shown in the drawing, where:

FIG. 1 shows the lubricating device in the upper part of a casting mold in a vertical cross section;

FIG. 2 is a top view of the lubricating device.

DETAILED DESCRIPTION OF PREFERRED EXAMPLE EMBODIMENTS

Figure 3:
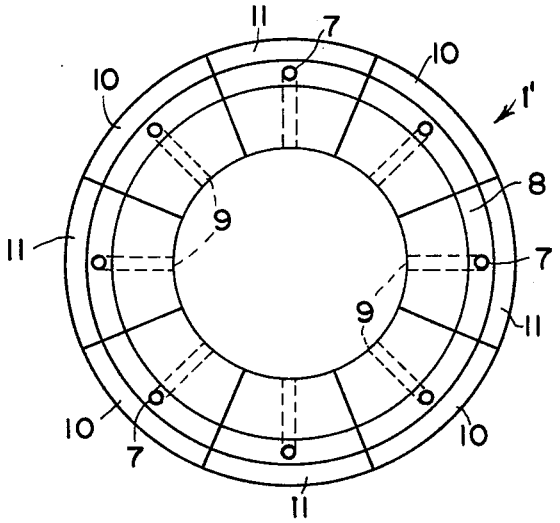
FIG. 3 is a top plan view of a distributor ring made of sectors of magnetic and non-magnetic material arranged in alternating fashion.

The device comprises essentially a distributor ring 1, which is supported so that it may rotate freely, in a recess 2 on the top side of an upper flange 3 of a mold 4, and is covered by a flange 5. The inside diameter of the distributor ring 1 corresponds to the inside diameter of the flanges 3 and 5, which is the same as the diameter of the cavity of the mold 4.

The cover flange 5, which extends beyond the outside diameter of the distributor ring 1 has a hole 7 in the vicinity of the distributor ring 1, for connecting a lubricant feed line 6, which leads to a circular slot arranged on the top side of the distributor ring 1 and, together with the cover flange 5, forms a ring chamber or groove 8. The ring chamber or groove 8 communicates with the cavity of the mold 4 through radial channels 9 milled into the bottom side of the distributor ring 1 in star-fashion, so that, for instance, rape-oil gets into the ring chamber or groove 8 through the lubricant feed line 6 and is distributed from there, via the radial channels 9, uniformly over the circumference of the inside wall of the mold 4.

Arranging the radial channels 9 at the bottom side of the distributor ring 1 has the further advantage that the distributor ring 1 in the recess 2 requires no additional lubrication for frictionless rotating motion, as the surfaces of the recess 2, which are in contact with the distributor ring 1, are already sufficiently supplied with lubricant through the radial slots 9, whereby the lubricant is uniformly distributed over the surfaces due to the rotation.

By an appropriate rotary drive of the distributor ring 1, the distribution of the lubricant over the circumference of the inner wall of the mold is equalized so that a film of lubricant is produced over the inside wall, which can be adapted accurately to the requirements of an optimal lubrication.

For the rotary drive of the distributor ring 1, a nonstationary electromagnetic field may be used, whereby it is advantageous that such a field is already arranged at the height of the pouring level, not shown. However, it is also possible to bring about sufficient rotation through tab- or blade-shaped elements which are arranged about the distributor ring 1 and extend into the ring chamber or groove 8, the ring chamber or groove 8 being acted upon by the stream of lubricant tangentially in the direction of rotation of the distributor ring 1.

FIG. 3 is a top plan view similar to that of FIG. 2, however, omitting the feed line 6 and showing a distributor ring 1' made of sectors 10 of magnetic material alternating with sectors 11 of nonmagnetic material. The ring groove 8 extends through both types of sectors.

Figure 4:
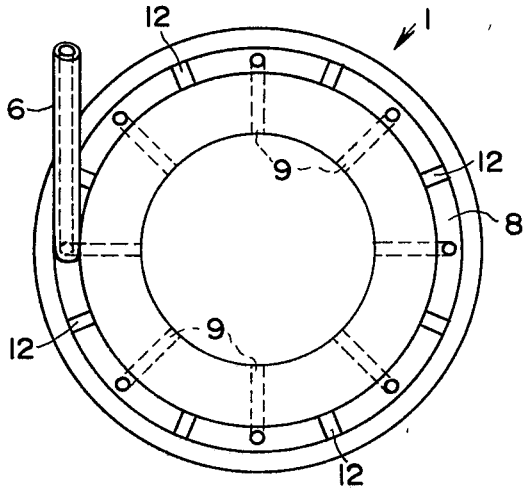
FIG. 4 is a top plan view similar to to FIG. 2, however, with the lubricant feed line extending tangentially to the lubricant groove.

FIG. 4 is a top plan view similar to that of FIG. 2, but showing the lubricant feed line 6 to be arranged tangentially relative to the ring chamber or groove 8. Thus, the lubricant flow through the lubricant feed line 6 contributes to rotating the distributor ring 1. The rotation may be further facilitated by radially extending driving elements 12 located in the lubricant distributor groove 8.

Figure 5:
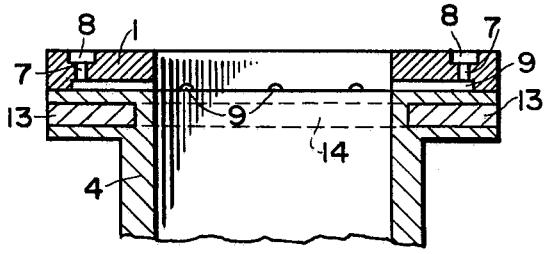
FIG. 5 shows a sectional view similar to FIG. 1 with electromagnetic inductor means for inducing a rotating electromagnetic field in the lubricant distributor ring.

FIG. 5 illustrates a view similar to that of FIG. 1 with certain parts omitted for simplicity's sake. The distributor ring 1 may be driven by inductor means 13 which provide a rotating magnetic field for rotating the lubricant distributor ring 1. The inductor coil means 13 may be located at the pouring level 14 of the mold 4 adjacent to the lubricant distributor ring 1.

It is to be understood that the distributor ring 1 may also be driven by a combination of different driving means, so that in every case, satisfactory dosing and distribution of the lubricant over the circumference of the inner wall of the mold 4 may be accomplished with the device according to the invention.

Although the invention has been described with reference to specific example embodiments, it is to be understood, that it is intended, to cover all modifications and equivalents within the scope of the appended claims.

I claim:

1. A continuous casting apparatus comprising mold means defining a substantially cylindrical mold cavity, a device for the delivery and uniform distribution of lubricants to the inside wall of said mold cavity, said mold means comprising an upper portion, annular chamber means in said upper mold portion, lubricant distributor ring means rotatably located in said chamber means, circular groove means in said distributor ring means, holding means rotatably holding said distributor ring means in said annular chamber means, lubricant supply means operatively connected to said holding means for supplying lubricant into said circular groove means, and lubricant conduit means operatively located for feeding lubricant into said mold cavity from said circular groove means.

2. The apparatus of claim 1, wherein said distributor ring means comprises sectors of magnetic material and sectors of nonmagnetic material arranged in alternating fashion, said apparatus further comprising inductor means arranged at the height of the pouring level of said mold means for generating a rotating electromagnetic field to rotate said distributor ring means.

3. The apparatus of claim 2, wherein said lubricant supply means further comprises a lubricant supply hole extending substantially tangentially to the circular groove means and through the holding means covering the distributor ring means, whereby lubricant is supplied into said circular groove means in the direction of rotation of the distributor ring means.

4. The apparatus of claim 3, wherein said distributor ring means comprises blade means extending substantially radially into said ring groove means, whereby the tangentially fed-in lubricant rotates the distributor ring means.

* * * * *